US006142571A

United States Patent [19]

Benden

[11] Patent Number: 6,142,571

[45] Date of Patent: Nov. 7, 2000

[54] FOOTREST APPARATUS FOR A CHAIR

[75] Inventor: Mark E. Benden, College Station, Tex.

[73] Assignee: Neutral Posture Ergonomics, Inc., Bryan, Tex.

[21] Appl. No.: 09/232,777

[22] Filed: Jan. 19, 1999

[51] Int. Cl.[7] ..... A47C 16/00

[52] U.S. Cl. ..... 297/423.4; 297/440.1

[58] Field of Search ..... 297/440.1, 463.1, 297/423.1, 423.4, 423.39, 463.2; 248/188.8, 188

[56] References Cited

U.S. PATENT DOCUMENTS

| | | | |
|---|---|---|---|
| 344,675 | 6/1886 | Ordway . | |
| D. 401,088 | 11/1998 | Chen | D6/498 |
| 1,933,096 | 10/1933 | Child . | |
| 2,529,780 | 11/1950 | Miller . | |
| 4,119,286 | 10/1978 | Barril . | |
| 4,171,847 | 10/1979 | Tukui . | |
| 4,915,450 | 4/1990 | Cooper | 297/423 |
| 5,098,160 | 3/1992 | Moore et al. | 247/423 |
| 5,344,217 | 9/1994 | McLaughlin | 297/423.25 |
| 5,419,618 | 5/1995 | Hatcher | 297/423.46 |
| 5,501,419 | 3/1996 | Huang . | |
| 5,577,806 | 11/1996 | Ugalde | 297/423.46 |
| 5,836,555 | 11/1998 | Ellsworth et al. . | |

FOREIGN PATENT DOCUMENTS

| | | |
|---|---|---|
| 326850 | 3/1930 | United Kingdom . |

OTHER PUBLICATIONS

3M Adjustable Footrest Information available on the world wide web on Dec. 22, 1998 at 3M'home page at: www.3m.com/market/omc/catalog/products/p00/p22/p83.html.

*Primary Examiner*—Milton Nelson, Jr.
*Attorney, Agent, or Firm*—Howrey Simon Arnold & White, LLP

[57] ABSTRACT

A footrest apparatus is described for use in the field of workstation design. The footrest apparatus comfortably supports the chair user's feet and includes a support section and a connecting section. The footrest apparatus may be detachably connected to chair legs.

17 Claims, 11 Drawing Sheets

FOOTREST APPARATUS FOR A CHAIR

BACKGROUND OF THE INVENTION

1. Field of the Invention

The invention relates to a footrest for a chair. More particularly, this invention relates to a footrest apparatus for maintaining the user's feet in a comfortable position.

2. Background of the Invention

In the workplace, persons such as machine operators and secretaries are often required to perform repetitive manual tasks in a sedentary position. Without proper support of the body, the person can become fatigued and possibly subjected to repetitive-motion injuries. It is now known that utilizing ergonomic principles in workstation design can help increase worker productivity, decrease worker fatigue, and reduce the likelihood of possible repetitive-motion injuries.

One area in which this proper support is especially necessary is the support of is the feet of a seated person. Without proper support of the feet, the feet and legs may be deprived of much-needed circulation. Unsupported feet tend to cause the seated person's ankles to swell. Not only is this unsupported position uncomfortable, but this position also leads to worker fatigue. Without proper support for the legs, proper circulation is hampered. Conversely, proper foot support facilitates blood flow through the legs which helps prevent fatigue and improves worker comfort.

It is commonly known in the workplace design industry that it is possible to provide free-standing footrests that are not directly attached to the chair of a seated person. However, the addition of another piece of furniture in the work area is not always desirable in many space-limited workplace designs. Further, chairs are often supported by legs with wheels or rollers. So it is possible that when a person places his feet on a separate footrest, he and his chair can roll away from the footrest.

It is also known to provide a grooved surface for these free-standing footrests to help prevent feet from sliding off the footrest surface. However, these grooves tend to retain dirt and generally do not provide sufficient traction to hold the feet in a secure, comfortable position.

Another conventional method of supporting the feet of a seated person in the workplace is by mounting a solid, typically metal ring or footring on the legs of a chair to support the feet of a seated person. However, because of the design of the legs of industrial chairs, these ringed supports hold the feet too far off the floor and position the feet at an uncomfortable, and ergonomically improper, angle. Further, because this type of support is permanently mounted, the adding or removing these supports to chairs can be difficult.

These footring footrests also cause complications if one chair is to be used by more than one person, such as in a multiple work-shift operation. When more than one person uses a chair, it is possible that one person may desire to use the footrest and another may not. Because these footring footrests circumscribe the chair legs and are permanently mounted to the chair legs, such a chair cannot be utilized by a person who does not want to use the footrests.

For the foregoing reasons, there is a need for a footrest that can support the feet at a comfortable angle.

SUMMARY OF THE INVENTION

In some aspects, the present invention relates to an apparatus and a method to support the feet of a person sitting in a chair. Specifically, according to one aspect of the invention, a footrest apparatus is designed for use in combination with a chair having a plurality of substantially horizontally extending legs, comprising one or more support sections adapted to receive the bottom surface of a user's foot or footwear, and one or more connecting sections functionally associated with said support sections, said connecting sections being detachably mounted on one or more legs of said chair, the upper surfaces of said one or more support sections being located below the upper surface of said substantially horizontal legs.

In some embodiments, the upper surface of each support section is angled from a horizontal plane. In some embodiments, this angle is between about 10 degrees and about 40 degrees. In some embodiments, this angle is approximately 30 degrees.

In some embodiments, each support section is substantially curvilinear. In some embodiments, the upper surface of each supporting section is provided with tactile bumps. In some embodiments the upper surface of each supporting section is further provided with tactile grooves.

In some embodiments, each connecting section further comprises an inside radius, each chair leg has an outside radius, the said inside radius of each connecting section being approximately equal to the outside radius of each chair leg to detachably connect the connecting sections to the chair legs.

In some embodiments, the footrest apparatus comprises a fastener attached to each connecting section for connecting the connecting sections to the chair legs. In some embodiments, the fastener is a nail. In some embodiments the fastener is a screw; in some embodiments the fastener is glue. In some embodiments, the fastener comprises each connecting section having an inside radius, each chair leg having an outside radius, the inside radius of each connecting section being approximately equal to said outside radius of each chair leg.

In another aspect, the footrest apparatus is designed for use in combination with a chair having five substantially horizontally extending legs, comprising two support sections adapted to receive the bottom surface of a user's foot or footwear, each support section being substantially curvilinear, and three connecting sections functionally associated with said support sections said connecting sections being detachably mounted on one or more legs of said chair, the upper surface of both support sections being located below the upper surface of said substantially horizontal legs, said upper surface of both support sections being angled from a horizontal plane at an angle of approximately 30 degrees and having tactile bumps, each connecting section further comprising an inside radius being approximately equal to an outside radius of each chair leg to detachably connect each connecting section to the chair legs.

In another aspect, a footrest apparatus is designed for use in combination with a chair having substantially horizontally extending legs, comprising at least one support section, each support section having a first end, a second end, and an upper surface adapted to receive the bottom surface of a user's foot or footwear, and means for detachably connecting each foot support section to one or more legs of said chair, said means being integrally connected to each end of each support section; each upper surface of each support section being located below the upper surface of the substantially horizontal chair legs. In some embodiments, each upper surface of each support section forms an angle to a horizontal plane.

In some embodiments, the angle the upper surface of each support section forms with the horizontal plane is between about 10 degrees and about 40 degrees. In some embodiments, this angle is approximately 30 degrees.

In another aspect, a method of supporting a seated person's feet on a chair having a plurality of substantially horizontally extending legs is provided comprising providing one or more support sections adapted to receive the bottom surface of a user's foot or footwear, providing at least two connecting sections functionally associated with said support sections, and connecting the corresponding supporting section to the chair leg. In another aspect, a method of supporting a seated person's feet on a chair having a plurality of substantially horizontally extending legs is provided comprising providing a footrest apparatus comprising one or more support sections having an upper surface, and at least one connecting section associated with each support section and adapted to connect the support section between adjacent chair legs so that the upper surface of each support section is below an upper surface of each adjacent chair leg, and engaging each connecting section to a chair leg.

DESCRIPTION OF ILLUSTRATIVE EMBODIMENTS

Embodiments of the invention will now be described with reference to the accompanying figures.

The invention relates to an apparatus and a method to support a person's feet while seated. In some embodiments, the footrest apparatus supports the person's feet without adding another piece of furniture to work area: the footrest is attached to the chair legs. In some embodiments, the footrest rests below the upper surface of the chair legs thus making the footrest closer to the floor and more comfortable to the user than prior footrests. In some embodiments, the feet-supporting section of the footrest is angled to provide additional comfort for the user.

Further aspects and advantages of the various embodiments of the invention will become apparent from consideration of the following description and drawings.

Figure 1A:
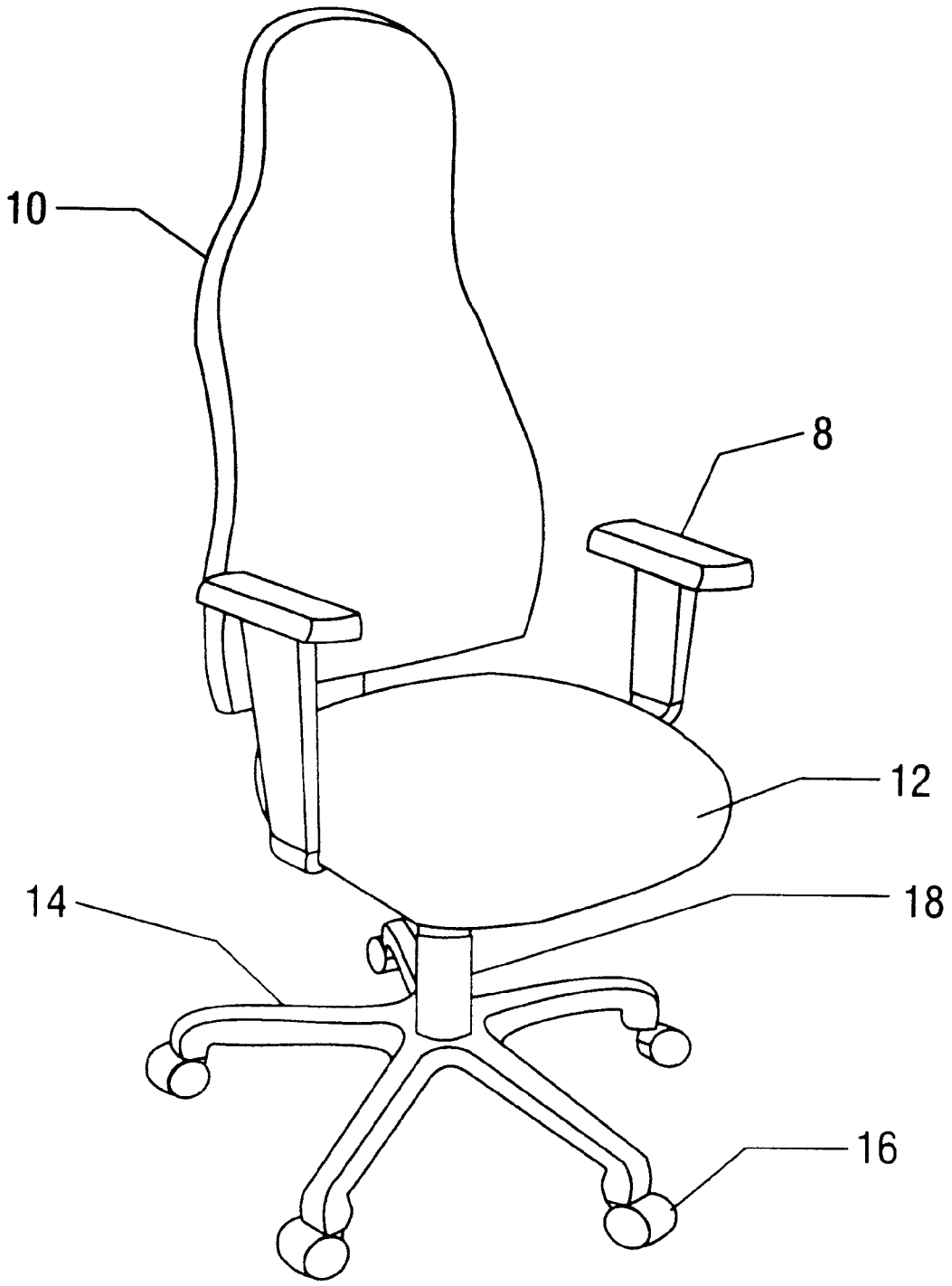
FIG. 1A (Prior Art)
FIG. 1A shows a prior art chair.

Referring to FIG. 1, a prior art industrial chair is shown to be made up for a chair back 10, a chair arm 8, a seat 12, resting on a support column 18 supported by chair legs 14 and chair rollers 16. Chair legs 14 are substantially horizontally extending legs. In operation a person (not pictured) sits in seat 12.

Figure 1B:
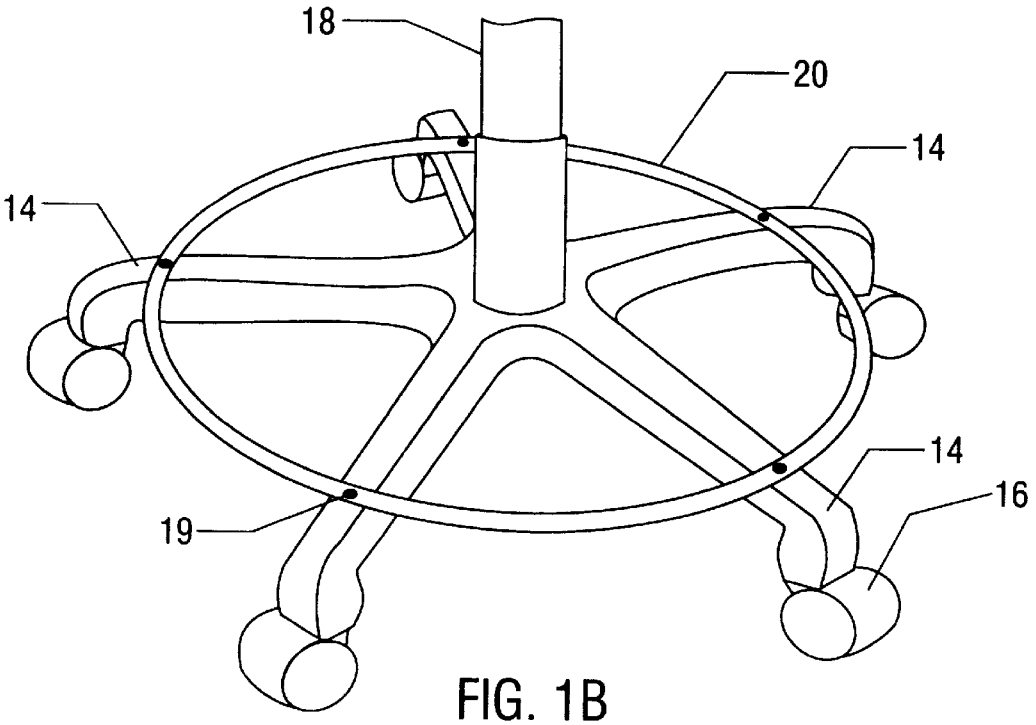
FIG. 1B (Prior Art)
FIG. 1B shows a prior art footring footrest.
Figure 1C:
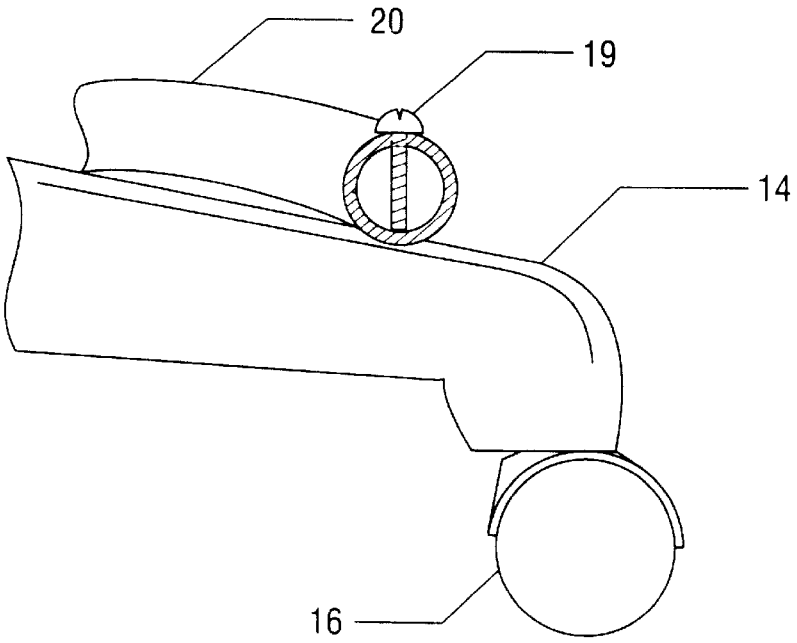
FIG. 1C (Prior Art)
FIG. 1C shows a cross section of the prior art footring footrest.

Referring to FIGS. 1B–1C a prior art footring 20 footrest is shown. Footring 20 is mounted on chair legs 14 by screws 19. In operation a person (not shown) rests her feet on footring 20. As shown in FIG. 1B, the footring 20 totally circumscribes the chair around the chair legs 14. Further as shown in FIG. 1C, footring 20 lies above chair legs 14.

Figure 2A:
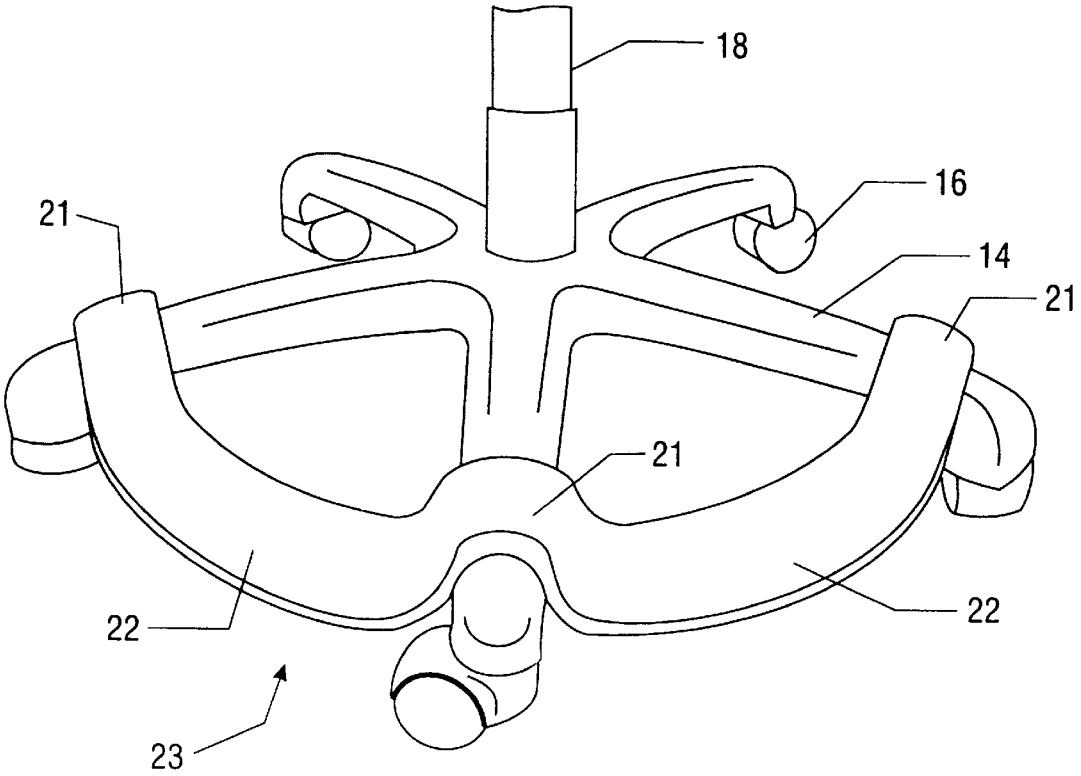
FIG. 2A shows an embodiment of the invention.

Referring to FIG. 2A, one embodiment of the present invention is shown. In this embodiment a footrest apparatus 23 is comprised of two support sections 22 and three connecting sections 21. The support sections 22 are adapted to receive the bottom surface of a user's feet or footwear. In operation a seated person (not pictured) rests his feet on support section 22. On each end of support section 22 is located a connecting section 21. Connecting section 21 connects each supporting section 22 to adjacent chair legs 14 as shown. Thus, in this embodiment, some of the adjacent legs are provided with a footrest between them and some are not. Thus, in these embodiments, the chair can be utilized by persons desiring the footrests and by persons not desiring the footrest simply by rotating the chair seat.

Figure 2B:
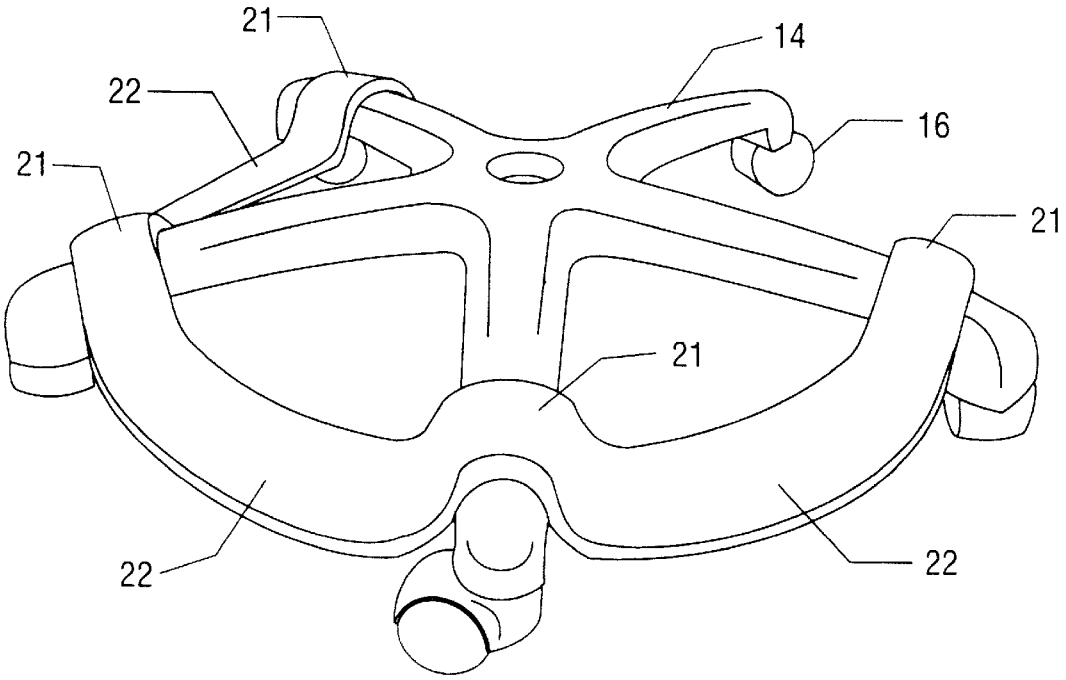
FIG. 2B shows an embodiment of the invention.

Referring to FIG. 2B another embodiment of the present invention is shown in which the footrest apparatus 23 is comprised of three support sections 22 and four connecting sections 21.

In FIG. 2A, while two of the areas between adjacent chair legs 14 have the footrest apparatus, three of the areas between chair legs 14 do not have footrests. Again in this versatile way, the same chair may be utilized by a person wanting footrests, or alternatively, the chair could be rotated so that it might be used without the footrests.

Figure 2C:
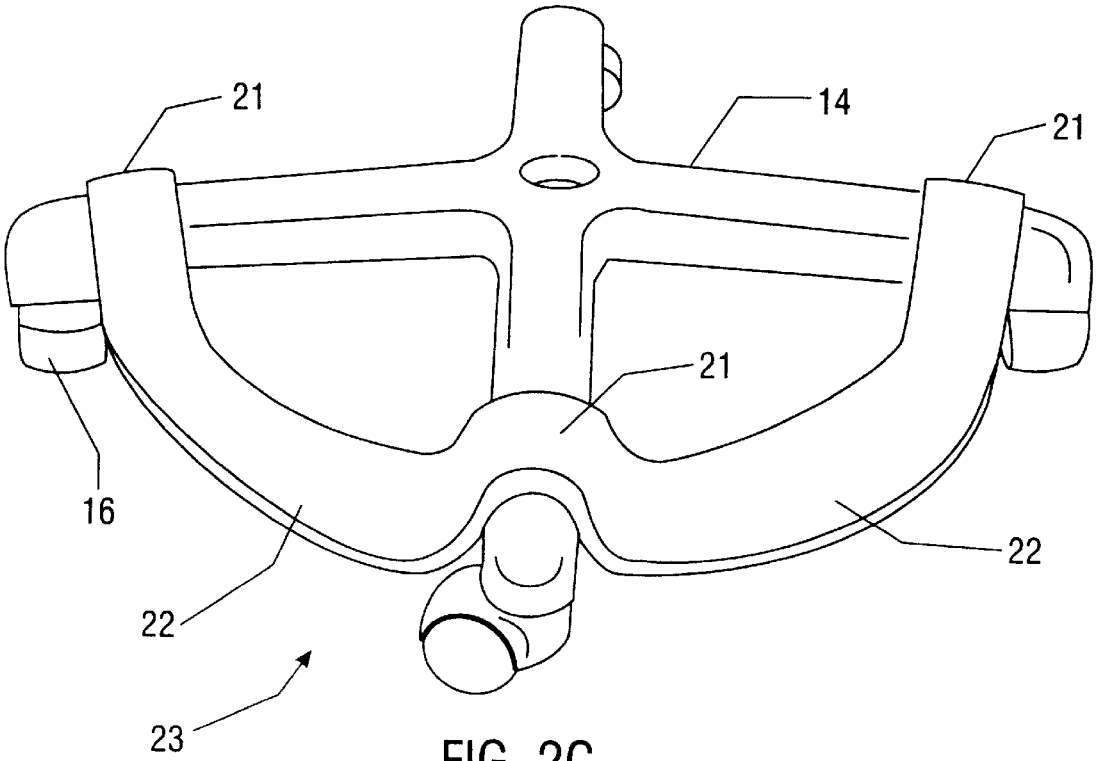
FIG. 2C shows an embodiment of the invention.

FIG. 2C shows another embodiment of the invention in which the footrest assembly 23 is mounted on a chair with four legs 14. In this embodiment the footrest apparatus 23 is comprised of two support sections 22 and three connecting sections 21.

Figure 2D:
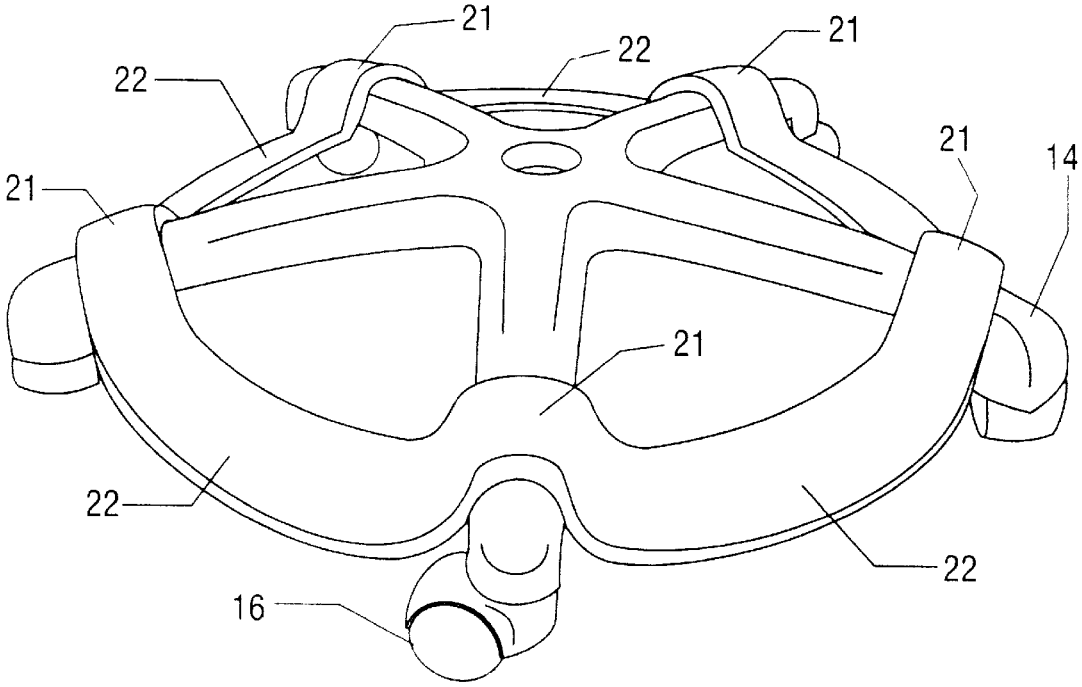
FIG. 2D shows another embodiment of the invention.

Referring to FIG. 2D, another embodiment of the invention is shown in which the footrest totally surrounds the entire chair leg section of the chair. In this embodiment the five support sections 22 in six connecting sections 21 are shown. While in these figures chairs with either four or five legs are shown, some embodiments of the current invention could be utilized with chairs having any number of legs. Further, footrest assembly 23 could be comprised of any number of support sections 22 and connecting sections 21 to attach the footrest apparatus to any number of adjacent chair legs 14.

Figure 3A:
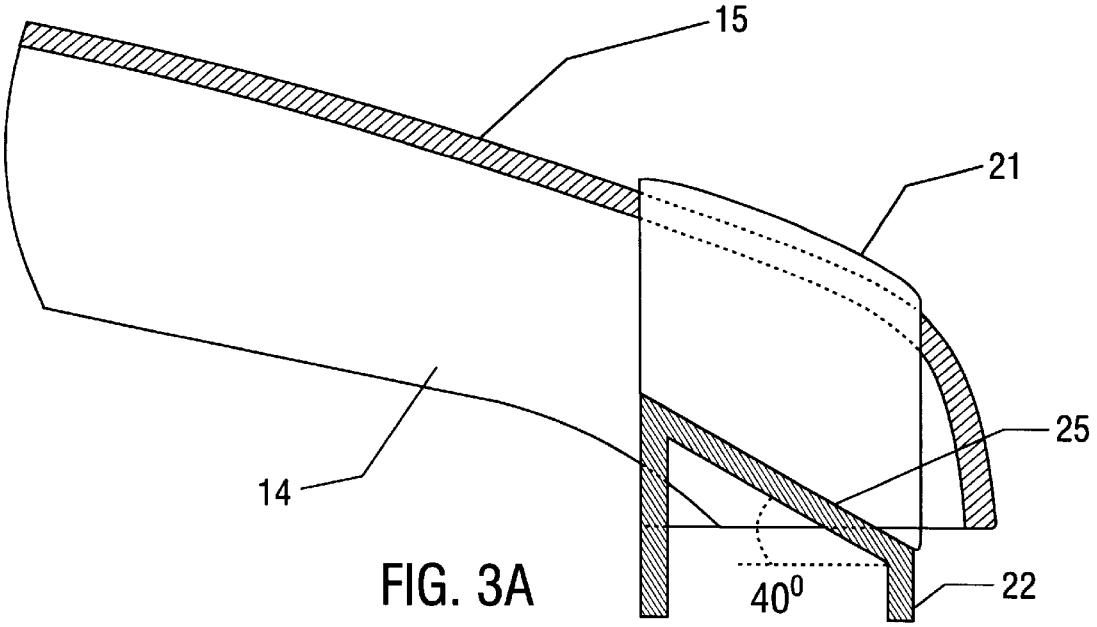
FIG. 3A shows a cross-sectional view of one embodiment of the invention.
Figure 3B:
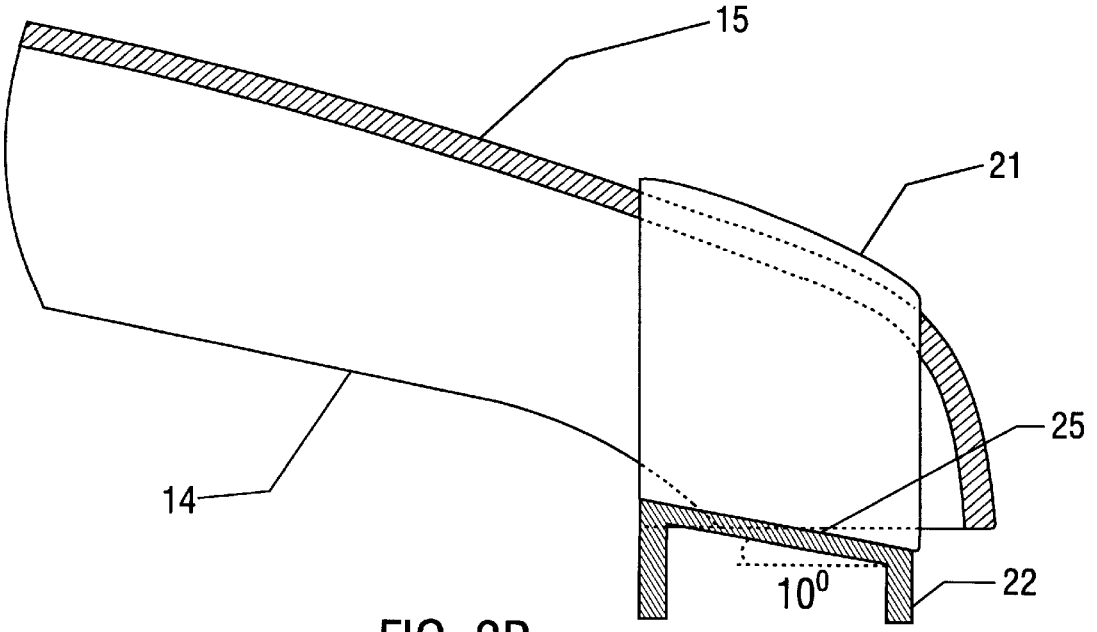
FIG. 3B shows another cross-sectional view of an embodiment of the invention.

FIGS. 3A–3B show a cross-sectional view of embodiments of the present invention. These embodiments show the upper surface 25 of support section 22 to be adapted to receive the bottom surface of a user's feet or footwear. This support section is connected to the substantially horizontally extending chair leg 14 by connecting section 21. Also shown is the upper surface 15 of chair leg 14. In these embodiments of the invention, the upper surface 25 of the support section 22 is closer to the floor than upper surface 15 of chair leg 14. Thus, upper surface 25 of support section 22 is below the upper surface 15 of the substantially horizontal legs. This allows a person to rest his feet in a more comfortable position since the support section 22 is lower to the floor than if the footrest were located above at or above the upper surface of the chair leg.

Upper surface 25 of support section 22 is shown in these embodiments to be angled to the horizontal plane. In FIG. 3A, the angle that the upper surface 25 of support section 22 makes with a horizontal plane is approximately 40 degrees. In FIG. 3B the angle that the upper surface 25 of support section 22 makes with a horizontal plane is approximately 10 degrees. It has been found that by having an angle between 10 and 40 degrees, preferably 30 degrees, the user is more comfortable and less fatigued. More particularly it has been found that fatigue is reduced and circulation is improved with this angled, upper surface 25.

Figure 4A:
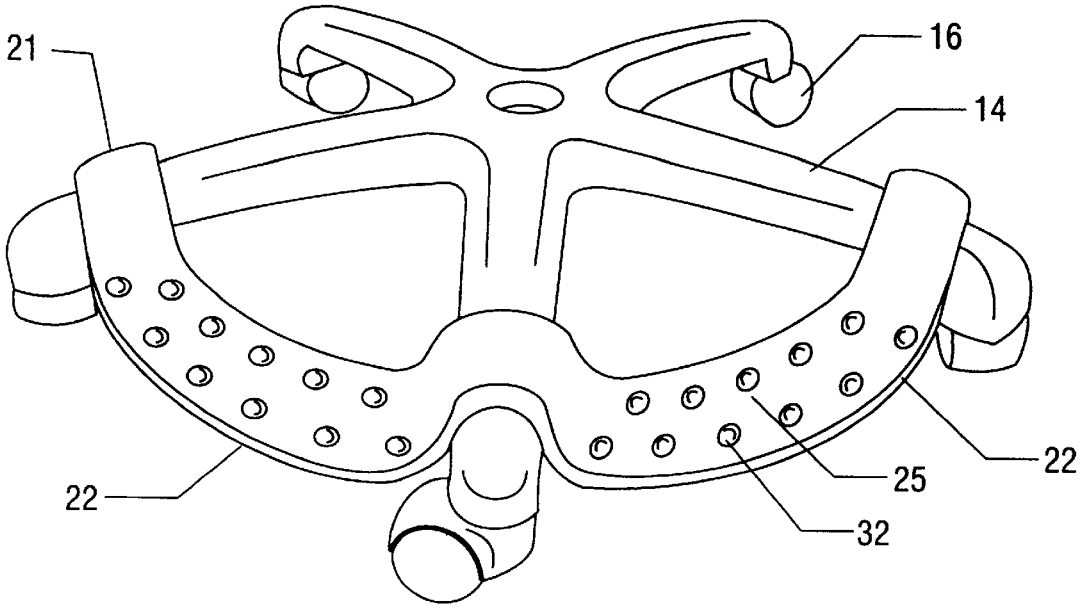
FIG. 4A shows an embodiment of the invention with tactile bumps.
Figure 4B:
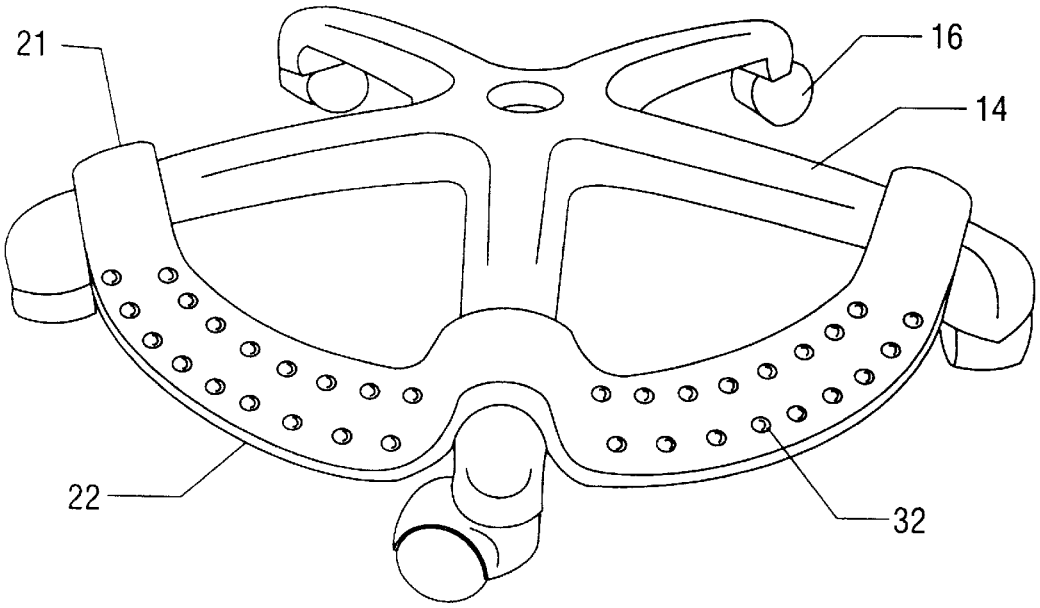
FIG. 4B shows an embodiment of the invention with tactile bumps.

Referring to FIGS. 4A and 4B in these embodiments, upper surface 25 is provided with tactile bumps 32. The tactile bumps are strategically placed along the upper surface 25 of support section 22. Preferably the diameter of these hemispherical tactile bumps is approximately ⅜th inch. In these embodiments, the tactile bumps have been found to be more comfortable and less fatiguing to a seated person than other configurations. Further tactile bumps have been found to retain less unwanted debris from the bottoms of shoes than other traction devices. Preferably the tactile bumps are placed as shown in FIG. 4A: equilateral triangularly spaced with eleven tactile bumps on each support section. However, other configurations, as shown in FIG. 4B, may be utilized.

Figure 4C:
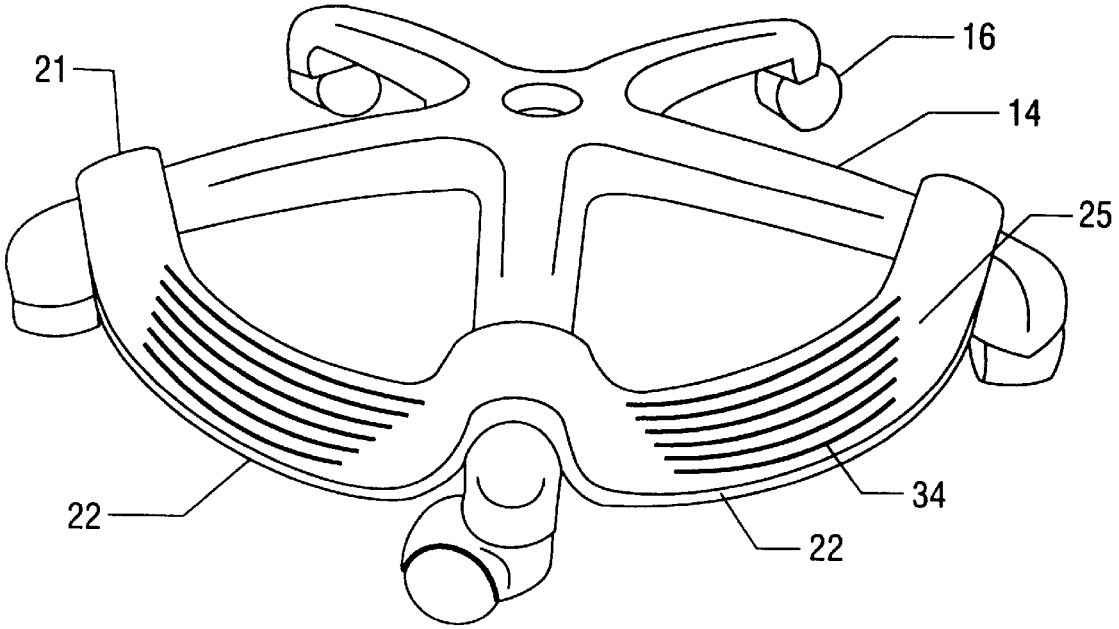
FIG. 4C shows an embodiment of the invention with tactile grooves.

FIG. 4C shows another method of producing traction to hold a user's feet in place: tactile grooves 34. These tactile grooves 34 are made in the upper surface 25 along support section 22.

Figure 3C:
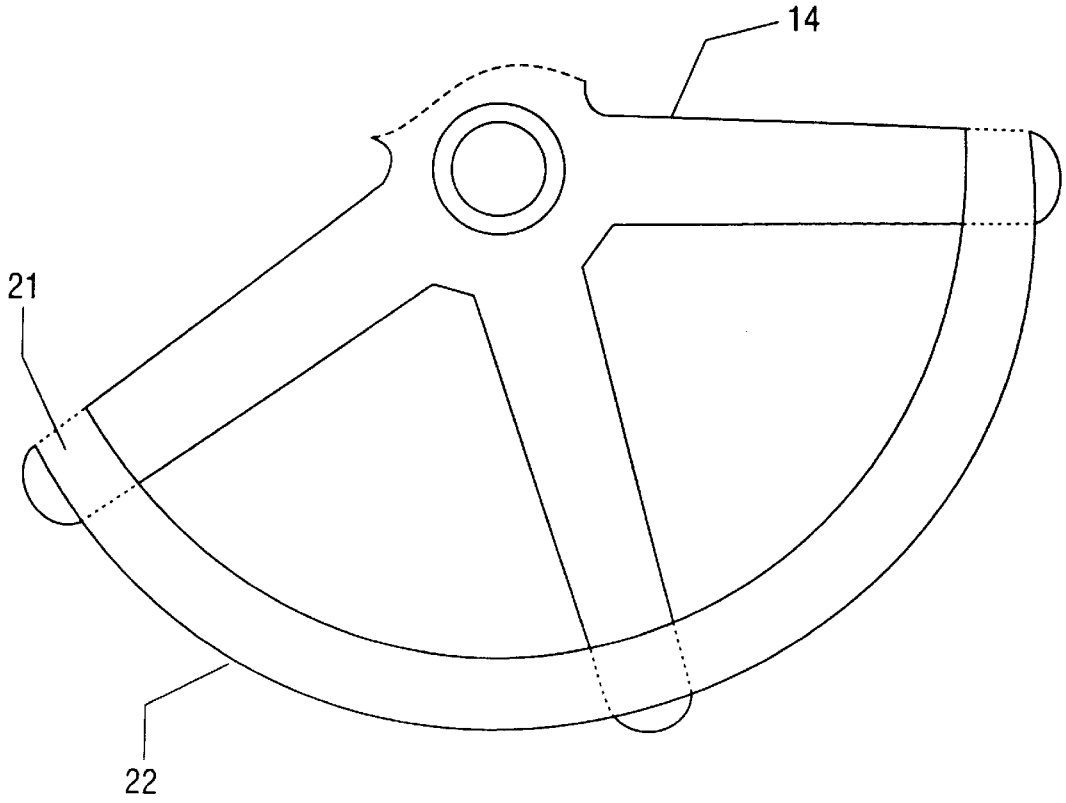
FIG. 3C shows a top view of one embodiment of the invention.
Figure 3D:
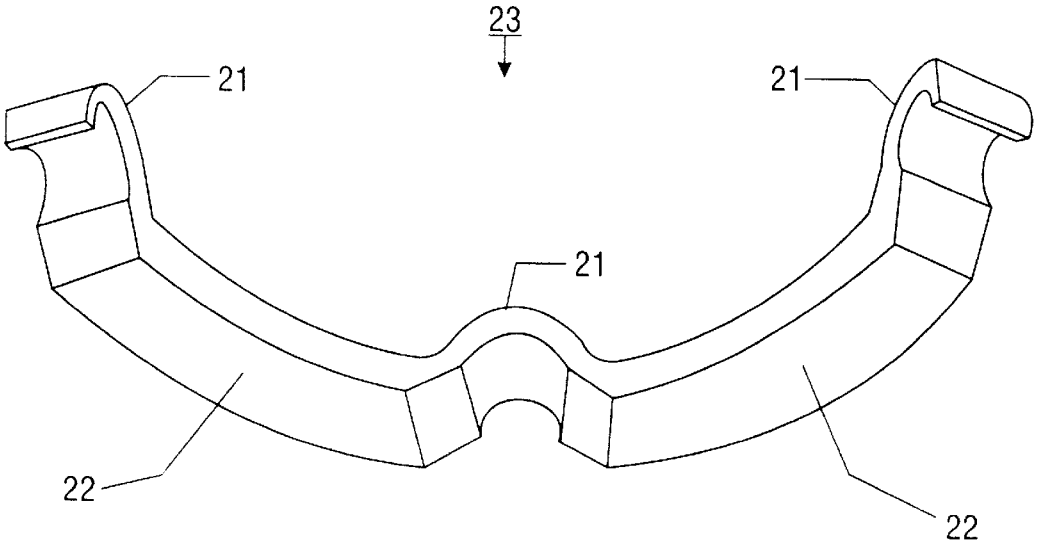
FIG. 3D shows a perspective view of one embodiment of the invention.
Figure 3E:
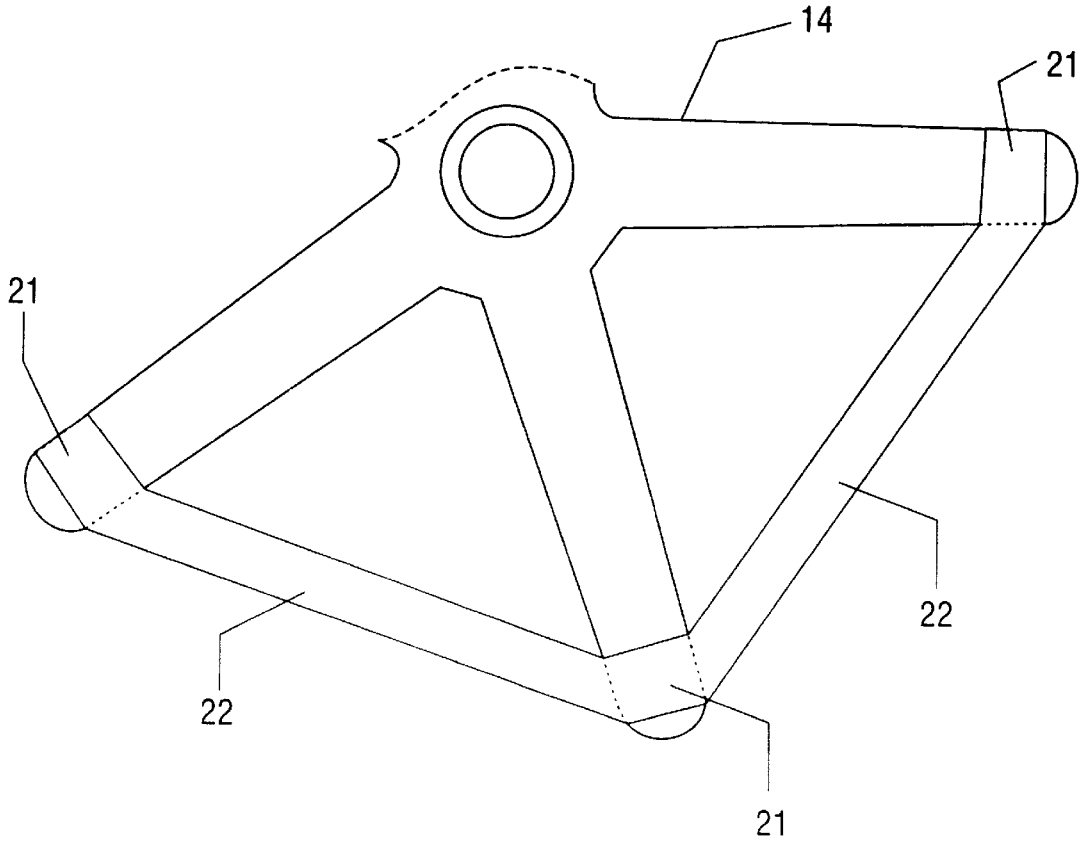
FIG. 3E shows another embodiment of the invention.

Referring to the embodiment shown in FIG. 3C, support section 22 is shown to be substantially curvilinear. In the embodiment shown in FIG. 3E, support section 22 is shown to be linear, not curvilinear. Finally, in FIG. 3D, one embodiment of the footrest apparatus is shown unattached to any chair legs.

Figure 5A:
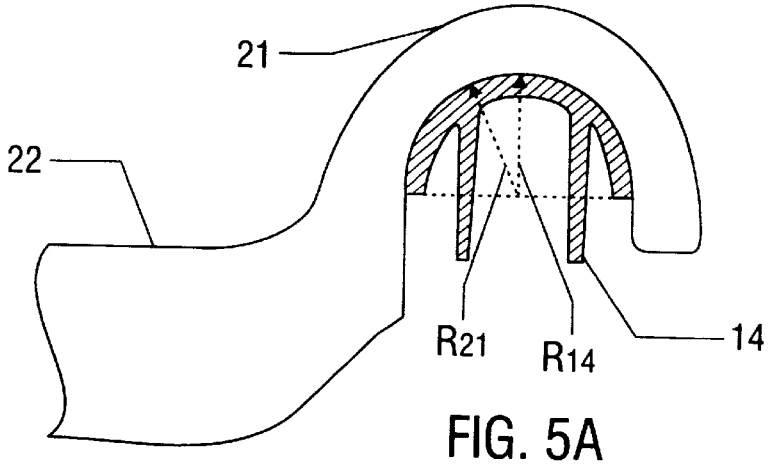
FIG. 5A shows an embodiment of the invention.

Referring to FIGS. 5A–5E, the connecting section 21 is attached to chair leg 14 as illustrated. In FIG. 5A, chair leg 14 has an outer radius of $R_{14}$. Similarly connecting section 21 has an inner radius of $R_{21}$. As shown in FIG. 5A, preferably $R_{21}$ is approximately equal to $R_{14}$. Therefore, connecting section 21 is attached to chair leg 14 by this concentric snap fit. Thus, footrest apparatus 23 may be easily attached and detached to chair legs 14.

Figure 5B:
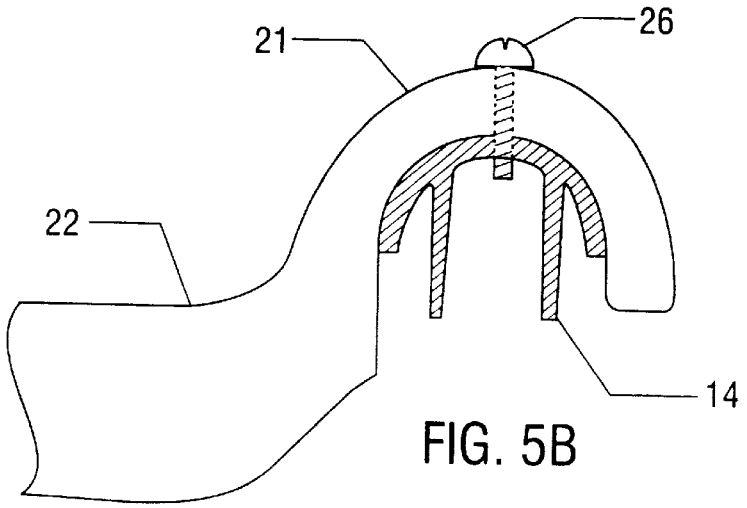
FIG. 5B shows an embodiment in which the fastener is a screw.
Figure 5C:
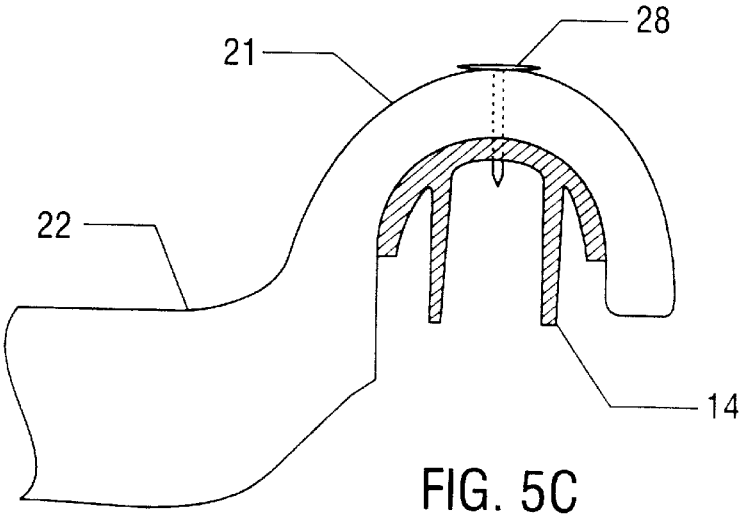
FIG. 5C shows an embodiment in which the fastener is a nail.
Figure 5D:
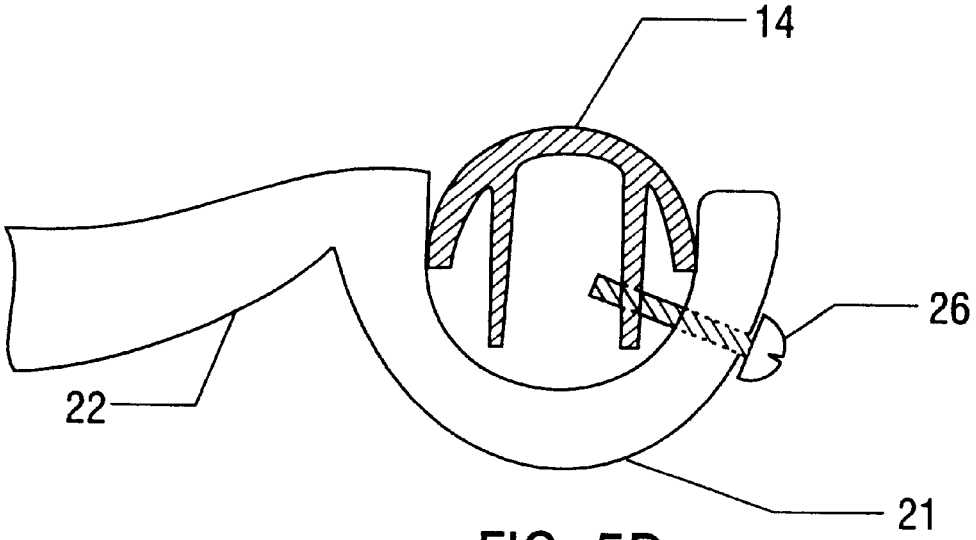
FIG. 5D shows an embodiment in which the fastener is inverted.
Figure 5E:
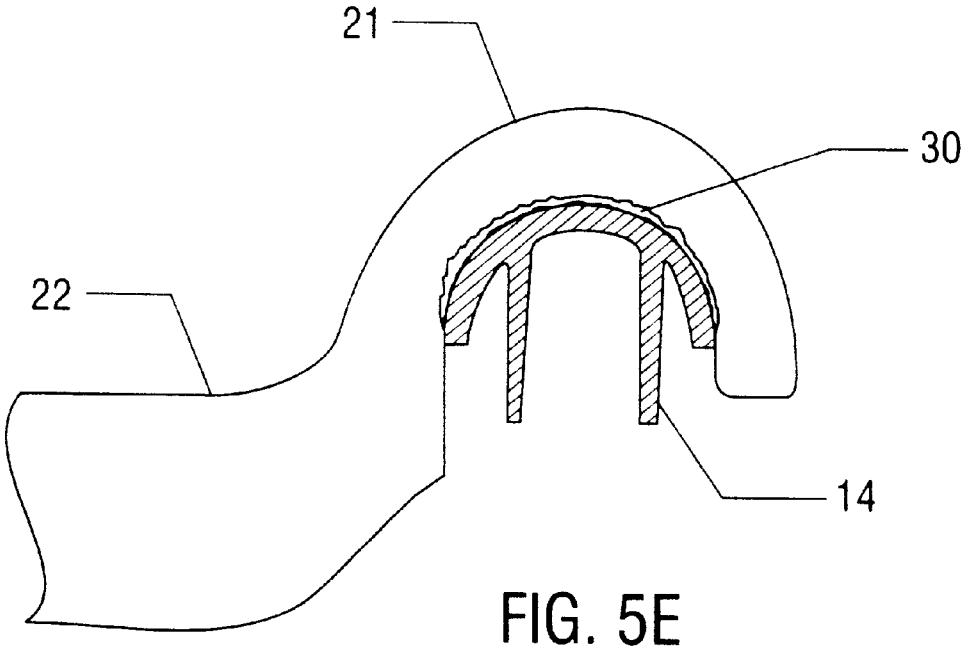
FIG. 5E shows an embodiment in which the fastener is glue.

In FIG. 5B, a screw 26 is used to fasten connecting section 21 to chair leg 14. In FIG. 5C, a nail 28 is used to attach connecting section 21 to chair leg 14. In FIG. SD, again a screw 26 is used to connecting section 21 to chair leg 14. However, the connecting section in FIG. 5D is inverted. Thus, footrest apparatus 23 may be attached to chair legs 14 in many ways. Finally in FIG. 5E, glue 30 is used to attach connecting section 21 to chair leg 14.

In some embodiments, the footrest apparatus 23—comprised of the support sections 22 and connecting sections 21—is preferably formed of a suitable material, such as injection-molded plastic.

Although various embodiments have been shown and described, the invention is not so limited and will be understood to include all such modifications and variations as would be apparent to one skilled in the art.

What is claimed is:

1. A footrest apparatus for use with a chair having a plurality of substantially horizontally extending legs, comprising:

a support section adapted to receive a bottom surface of a user's footwear, said support section having an upper surface; and, at least two connecting sections functionally associated with said support section, said connecting sections being detachably mountable to the plurality of substantially horizontally extending legs of said chair, such that the upper surface of said support section is located below an upper surface of said plurality of substantially horizontally extending legs when said connecting sections are mounted to said plurality of substantially horizontally extending legs, the upper surface of said support section being angled from a horizontal plane, the angle the upper surface of said support section forms with the horizontal plane being 30 degrees.

2. A footrest apparatus for use with a chair having a plurality of substantially horizontally extending legs, comprising:

a support section adapted to receive a bottom surface of a user's footwear, said support section having an upper surface; and, at least two connecting sections functionally associated with said support section, said connecting sections being detachably mountable to the plurality of substantially horizontally extending legs of said chair, such that the upper surface of said support section is located below an upper surface of said plurality of substantially horizontally extending legs when said connecting sections are mounted to said plurality of substantially horizontally extending legs, each connecting section having an inside radius, each of said connecting sections having an upper surface, said inside radius of each said connecting section being detachably mountable to one of said substantially horizontally extending chair legs with a concentric snap fit connection, said upper surface of each said connecting section being located at a location above said upper surface of the plurality of substantially horizontally extending chair legs when said connecting sections are mounted to said plurality of substantially horizontally extending legs.

3. The footrest apparatus according to claim 2 in which the support section is curvilinear.

4. The footrest apparatus according to claim 2 in which the upper surface of the support section is provided with tactile bumps.

5. The footrest apparatus according to claim 2 in which the upper surface of the support section is further provided with tactile grooves.

6. A footrest apparatus for use with a chair having a plurality of substantially horizontally extending legs, comprising:

a support section adapted to receive a bottom surface of a user's footwear, said support section having an upper surface;

at least two connecting sections functionally associated with said support section, said connecting sections being detachably mountable to the plurality of substantially horizontally extending legs of said chair, such that the upper surface of said support section is located below an upper surface of said plurality of substantially horizontally extending legs when said connecting sections are mounted to said plurality of substantially horizontally extending legs; and, a fastener attached to each connecting section for connecting the connecting sections to the plurality of substantially horizontally extending chair legs, the fastener being a concentric snap fit connection, each connecting section having an inside radius, each connecting section having an upper surface, said inside radius of each said connecting section being detachably mountable to one of said substantially horizontally extending chair legs, via said concentric snap fit connection, said upper surfaces of said each connecting section being located at a location above said upper surface of the plurality of substantially horizontally extending chair legs when said connecting sections are mounted to said plurality of substantially horizontally extending legs.

7. A footrest apparatus for use with a chair having five horizontally extending legs, comprising:

two support sections adapted to receive a bottom surface of a user's footwear, each support section being curvilinear, each of said support sections having an upper surface; and three connecting sections functionally associated with said support sections, said connecting sections being detachably mountable to three horizontally extending legs of said chair, such that the upper surfaces of both support sections are located below an upper surface of said horizontally extending legs when said connecting sections are mounted to said three horizontally extending legs, said upper surfaces of both support sections being angled from a horizontal plane at an angle of 30 degrees and having tactile bumps;

each said connecting sections having an upper surface;

each connecting section having an inside radius;

said inside radius of each said connecting section being detachably mountable to said horizontally extending legs with a concentric snap fit connection, said upper surface of each connection section being located at a location above said upper surface of the horizontally extending chair legs when said connecting sections are mounted to said plurality of horizontally extending legs.

8. A footrest apparatus for use with a chair having a plurality of substantially horizontally extending legs, comprising:

at least one support section, each support section having a first and a second end, and each support section having an upper surface adapted to receive a bottom surface of a user's footwear; and means for detachably connecting each support section to said plurality of substantially horizontally extending legs, said plurality of substantially horizontally extending legs having an upper surface, said means for detachably connecting being integrally connected to each end of each support section; each upper surface of each support section being located below the upper surface of the plurality of substantially horizontally extending legs when said means for detachably connecting is connected to said plurality of substantially horizontally extending legs, each upper surface of each support section forming an angle to a horizontal plane, the angle the upper surface of each support section forms with the horizontal plane being 30 degrees.

9. A footrest apparatus for use with a chair having a plurality of substantially horizontally extending legs, comprising:

a support section adapted to receive a bottom surface of a user's footwear, said support section having an upper surface, and;

at least two connecting sections functionally associated with said support section, said connecting sections being detachably mountable to the plurality of substantially horizontally extending legs of said chair, such that the upper surface of said support section is located below an upper surface of said plurality of substantially horizontally extending legs when said connecting sections are mounted to said plurality of substantially horizontally extending legs, said connecting sections being detachably mountable to said plurality of horizontally extending legs at a location above said upper surface of the substantially horizontally extending legs.

10. A detachable footrest apparatus for use with a chair having a plurality of substantially horizontally extending legs, comprising:

a support section adapted to receive a bottom surface of a user's shoes, said support section having an upper surface, a first end and a second end;

a first connecting section connected to the first end of the support section; and a second connecting section connected to the second end of the support section, said first and second connecting sections being detachably mountable to said plurality of substantially horizontally extending legs, such that the upper surface of said support section is located below an upper surface of said plurality of substantially horizontally extending legs when said connecting sections are mounted to said plurality of substantially horizontally extending legs;

each connecting section having an inside radius for conformally attaching each connecting section to the upper surface of one of the substantially horizontally extending legs, each of said connecting sections having an upper surface, said upper surface of said connecting sections being located at a location above said upper surface of the plurality of substantially horizontally extending chair legs when said connecting sections are mounted to said plurality of substantially horizontally extending legs.

11. The footrest apparatus according to claim 10 in which the support section is curvilinear.

12. The footrest apparatus according to claim 10 in which the upper surface of the support section is provided with tactile bumps.

13. The footrest apparatus according to claim 10 in which the upper surface of the support section is further provided with tactile grooves.

14. A detachable footrest for a chair having a plurality of horizontally-extending legs, comprising:

a support section having a substantially flat upper surface; and a connecting section associated with said support section, said connecting section being connectable to adjacent said horizontally-extending legs so that the upper surface of the support section is below an upper surface of each adjacent leg;

said connecting section having an upper surface, said upper surface of said connecting section being above said upper surface of each adjacent horizontally-extending leg when said connecting section is mounted to said each adjacent horizontally-extending leg.

15. The footrest apparatus according to claim 14 in which the support section is curvilinear.

16. The footrest apparatus according to claim 14 in which the upper surface of the support section is provided with tactile bumps.

17. The footrest apparatus according to claim 14 in which the upper surface of the support section is further provided with tactile grooves.

* * * * *